US011459207B2

(12) United States Patent
Arai et al.

(10) Patent No.: US 11,459,207 B2
(45) Date of Patent: Oct. 4, 2022

(54) SAFETY LINK WITH PULLEY

(71) Applicant: Otis Elevator Company, Farmington, CT (US)

(72) Inventors: Hideki Arai, Chiba-Ken (JP); Tanaka Takashi, Chiba-Ken (JP); Hideaki Sasaki, Chiba-Ken (JP); Michiyuki Sato, Chiba-Ken (JP); Shinichiro Oga, Chiba-Ken (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 83 days.

(21) Appl. No.: 16/912,133

(22) Filed: Jun. 25, 2020

(65) Prior Publication Data

US 2021/0403286 A1 Dec. 30, 2021

(51) Int. Cl.
*B66B 5/04* (2006.01)
*B66B 5/18* (2006.01)

(52) U.S. Cl.
CPC ..... *B66B 5/044* (2013.01); *B66B 5/18* (2013.01)

(58) Field of Classification Search
CPC B66B 5/044; B66B 5/042; B66B 5/22; B66B 5/18; B66B 5/04; B66B 7/10
See application file for complete search history.

(56) References Cited

U.S. PATENT DOCUMENTS 3,346,073 A * 10/1967 Martin ..... B66B 5/18 187/375
4,662,481 A * 5/1987 Morris ..... B66B 5/044 187/373
5,230,406 A * 7/1993 Poon ..... B66B 5/04 187/376
6,202,795 B1 * 3/2001 Bluteau ..... B66B 5/04 187/287
8,720,262 B2 * 5/2014 Windlin ..... B66B 5/048 73/121
2016/0325964 A1 * 11/2016 Haapaniemi ..... B66B 5/22
2017/0073190 A1 * 3/2017 Dube ..... B66B 5/04

FOREIGN PATENT DOCUMENTS

DE 202015105373 U1 * 1/2017 ..... B66B 5/04
FR 2666317 A1 * 3/1992 ..... B66B 5/04
KR 880004393 Y1 * 12/1988

* cited by examiner

*Primary Examiner* — Michael R Mansen
*Assistant Examiner* — Michelle M Lantrip
(74) *Attorney, Agent, or Firm* — Cantor Colburn LLP

(57) ABSTRACT

A safety link for an elevator car traveling in an elevator hoistway includes a hitch bracket slidably mounted to the elevator car frame so as to be movable in the moving directions of the elevator car and biased toward the downward movement direction of the elevator car in normal operating condition, the hitch bracket connected to the governor rope, and a pulley rotatably mounted to the hitch bracket and including an actuation wire wrapped around the pulley and connected to a safety device.

16 Claims, 5 Drawing Sheets

SAFETY LINK WITH PULLEY

TECHNICAL FIELD

The present invention relates generally to an elevator safety device, and more particularly to a safety link of a safety device that automatically stops an elevator car from travelling when the descending speed of the elevator car exceeds a predetermined speed.

BACKGROUND ART

Most elevators have a safety device that works in conjunction with a governor to prevent the risk of the elevator car falling in the event of an unexpected situation such as a malfunction of the elevator drive motor, disconnection of elevator ropes, etc.

Specifically, a governor is arranged at a predetermined position such as in a machine room or in a hoistway of the elevator. The governor is equipped with an endless governor rope extending throughout the hoistway so as to move in conjunction with the elevator car moving upwardly or downwardly.

The governor is configured to detect the moving speed of the elevator car by detecting the moving speed of the governor rope connected to the elevator car. When the governor detects that the descending speed of the elevator car exceeds a predetermined speed, the governor grips the governor rope and pulls the governor rope upward with respect to the elevator car, causing a safety device to actuate via a safety link mounted on the elevator car.

When the safety device is actuated, free running time may be generated due to the delay of safety link operation, and in the worst case, descending speed of the elevator car may reach its maximum speed of 1G, which may delay the stop of the elevator car.

Therefore, there is a need for an improved safety link that prevents acceleration in descending speed of an elevator car due to the time lag between detection of a downward overspeed condition of the elevator car and the actuation of the safety device.

SUMMARY OF INVENTION

According to one aspect of the present invention, a safety link for an elevator traveling in an elevator hoistway is provided. The elevator includes a governor assembly and a governor rope extending throughout the hoistway. The safety link includes a hitch bracket slidably mounted to the elevator car frame so as to be movable in the moving directions of the elevator car and biased toward the downward movement direction of the elevator car in normal operating condition, the hitch bracket connected to the governor rope, a pulley rotatably mounted to the hitch bracket, and an actuation wire wrapped around the pulley. One end of the actuation wire is fixed to the elevator car frame so that the one end is directed downwardly relative to the pulley and the other end of the actuation wire is directed downwardly and connected to a safety device that stops the movement of the elevator car in the event of a downward overspeed condition.

In some embodiments, the safety link further includes a base bracket mounted to the elevator car frame to slidably hold the hitch bracket.

In some embodiments, the actuation of the governor rope in the event of a downward overspeed condition causes the hitch bracket to move upward, causing the pulley to pull upward relative to the base bracket, and thereby pulling the actuation wire to actuate the safety device.

In some embodiments, the movement of the actuation wire is twice as much as the corresponding movement of the governor rope.

In some embodiments, the actuation wire is wrapped 180° around the pulley.

In some embodiments, the actuation wire has a 2:1 roping configuration with the pulley.

In some embodiments, the hitch bracket is guided by a guide slot arranged in the hitch bracket and a guide bolt that slidably connects the hitch bracket through the guide slot to the elevator car frame.

In some embodiments, the safety link is arranged near the bottom of the side surface of the elevator car frame.

In some embodiments, the governor rope is connected to the hitch bracket by means of bolts.

In some embodiments, the safety device comprises a pair of safeties mounted on either side of the elevator car frame for applying a braking force to a pair of guide rails in response to the actuation of the governor rope.

In some embodiments, the pair of safeties are linked together through a second actuation wire.

According to another aspect of the present invention, a safety link for an elevator traveling in an elevator hoistway is provided. The elevator includes a governor assembly and a governor rope extending throughout the hoistway. The safety link includes a hitch bracket slidably mounted to the elevator car frame so as to be movable in the moving directions of the elevator car and biased toward the downward movement direction of the elevator car in normal operating condition, the hitch bracket connected to the governor rope, a pulley rotatably mounted to the hitch bracket, and an actuation wire wrapped around the pulley and connected to a safety device for actuation in response to the upward movement of the governor rope. The actuation wire has a 2:1 roping configuration with the pulley and the movement of the actuation wire is twice as much as the corresponding movement of the governor rope.

In some embodiments, the safety link further includes a base bracket mounted to the elevator car frame to slidably hold the hitch bracket.

In some embodiments, the actuation of the governor rope in the event of a downward overspeed condition causes the hitch bracket to move upward, causing the pulley to pull upward relative to the base bracket, and thereby pulling the actuation wire to actuate the safety device.

In some embodiments, the hitch bracket is guided by a guide slot arranged in the hitch bracket and a guide bolt that slidably connects the hitch bracket through the guide slot to the elevator car frame.

In some embodiment, the safety link is arranged near the bottom of the side surface of the elevator car frame.

In some embodiment, the safety device comprises a pair of safeties mounted on either side of the elevator car frame for applying a braking force to a pair of guide rails in response to the actuation of the governor rope.

In some embodiments, the pair of safeties are linked together through a second actuation wire.

These and other aspects of this disclosure will become more readily apparent from the following description and the accompanying drawings, which can be briefly described as follows.

DESCRIPTION OF EMBODIMENTS

Figure 1:
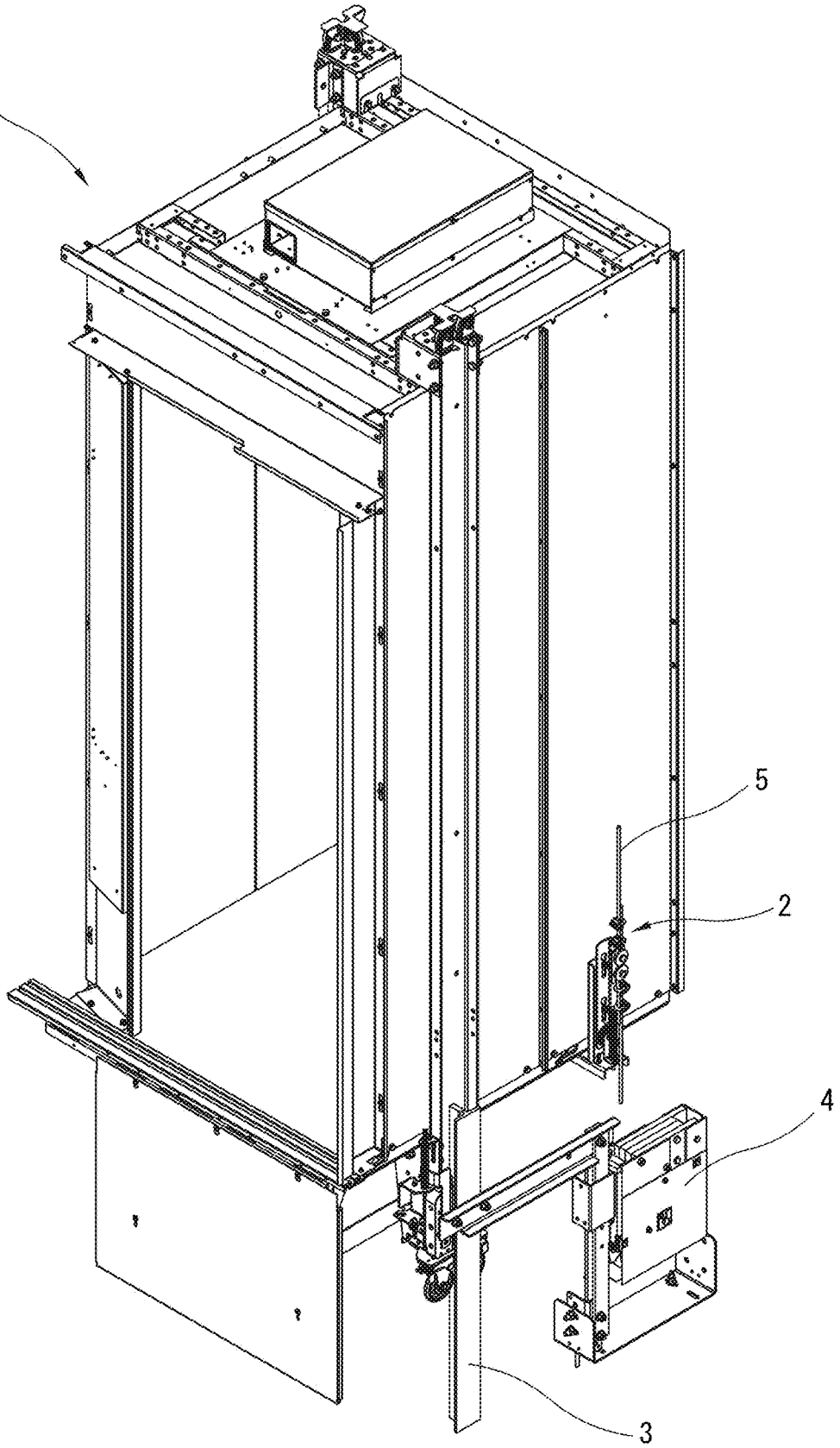
FIG. 1 is a schematic perspective view of an elevator car showing one possible arrangement of the safety link in accordance with the present invention.

FIG. 1 shows a perspective view of an elevator car 1 equipped with a safety link 2 of the present invention. The elevator car 1 moves vertically upward and downward along a pair of guide rails 3 within a hoistway (not shown).

The elevator system generally includes a governor 4 for limiting the speed of the elevator car 1 installed in the hoistway. The governor 4 includes a governor sheave (not shown) generally located at the top of the hoistway or in a machine room, a tension sheave (not shown) located at the bottom of the hoistway, and an endless governor rope 5 wrapped around the governor sheave and the tension sheave. The governor rope 5 extends along the hoistway between the governor sheave and the tension sheave in a looped manner. As shown in FIG. 1, the governor rope 5 is attached to the elevator car 1 via the safety link 2 in accordance with the present invention.

Figure 2:
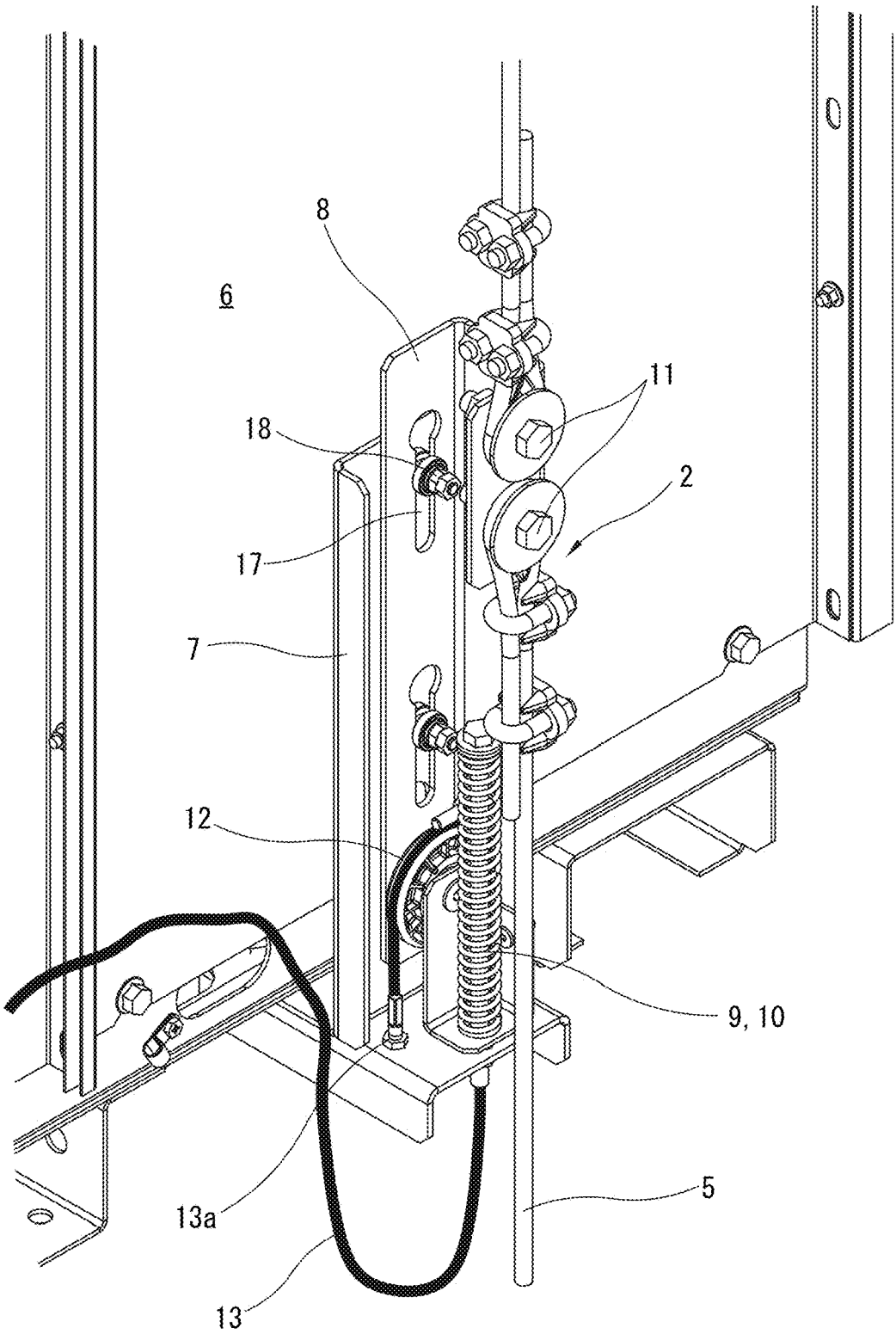
FIG. 2 is a schematic perspective view of the safety link in accordance with the present invention.
Figure 3:
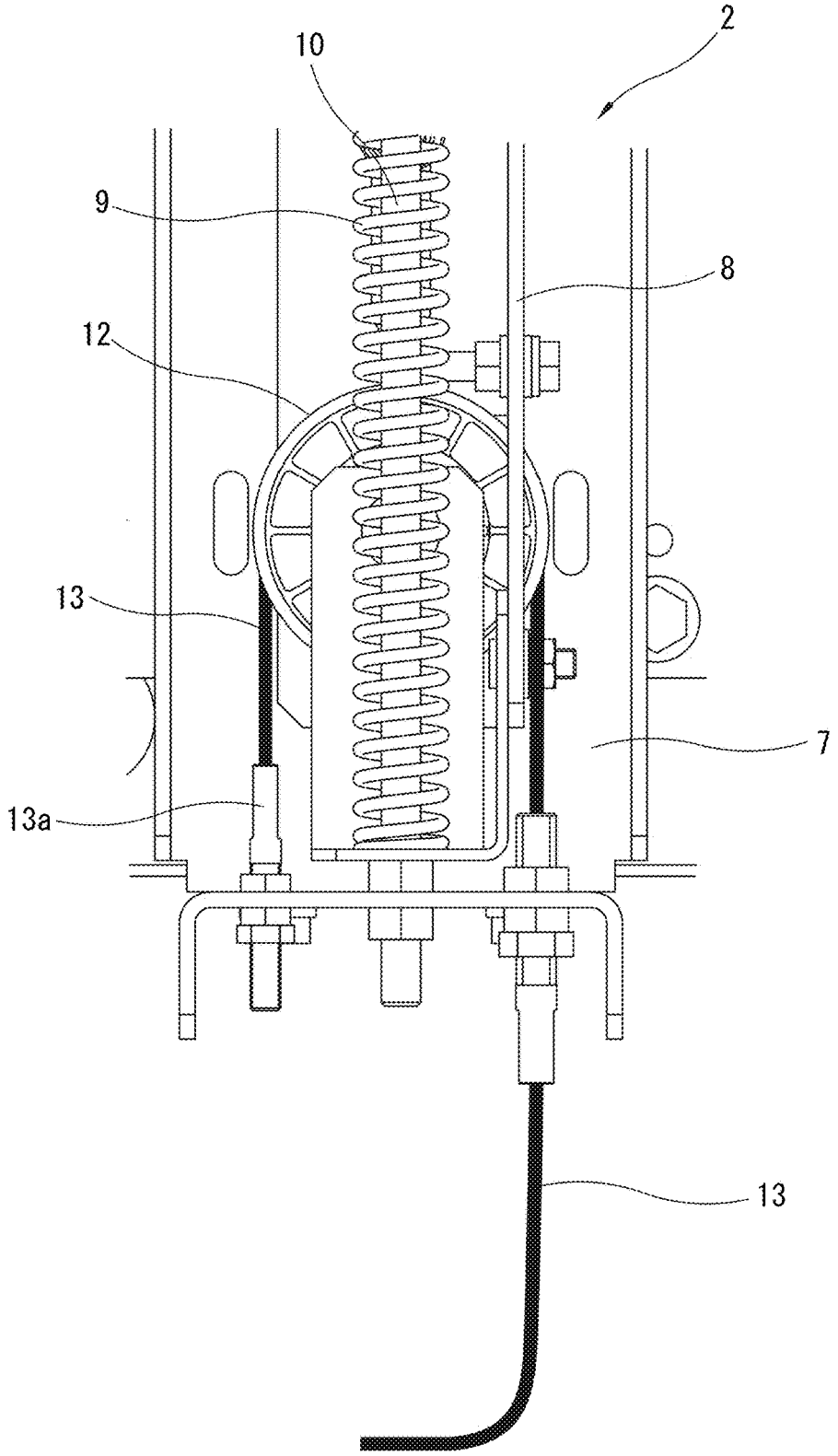
FIG. 3 is a front elevation view of the safety link of FIG. 2.

FIG. 2 shows a perspective view of the safety link 2 of the present invention mounted on the elevator car frame 6, and FIG. 3 shows a front view of the safety link 2.

As shown in FIG. 2, the safety link 2 comprises a base bracket 7 mounted to a predetermined position of the elevator car frame 6, for example, arranged proximately to the governor rope 5 and arranged near the bottom of the side surface of the elevator car frame 6, and a hitch bracket 8 mounted to the base bracket 7 so as to be slidably connected to the base bracket 7 in the moving directions of the elevator car 1. In one example, the hitch bracket 8 is guided by guide slots 17 arranged in the hitch bracket 8 and guide bolts 18 that slidably connect the hitch bracket 8 through the guide slots 17. A spring 9 is held by a rod 10, which penetrates the hitch bracket 8 and is fixed to the base bracket 7. The spring 9 is biased upward with respect to the base bracket 7 during normal operation of the elevator car 1. However, it should be understood that any configuration can be used to slidably connect the hitch bracket 8 to the base bracket 7 along the moving directions of the elevator car 1. The governor rope 5 is connected to the hitch bracket 8 by means of a connecting means such as screws or bolts 11. The hitch bracket 8 can move up and down along the base bracket 7 which serves as a sliding guide.

Figure 4:
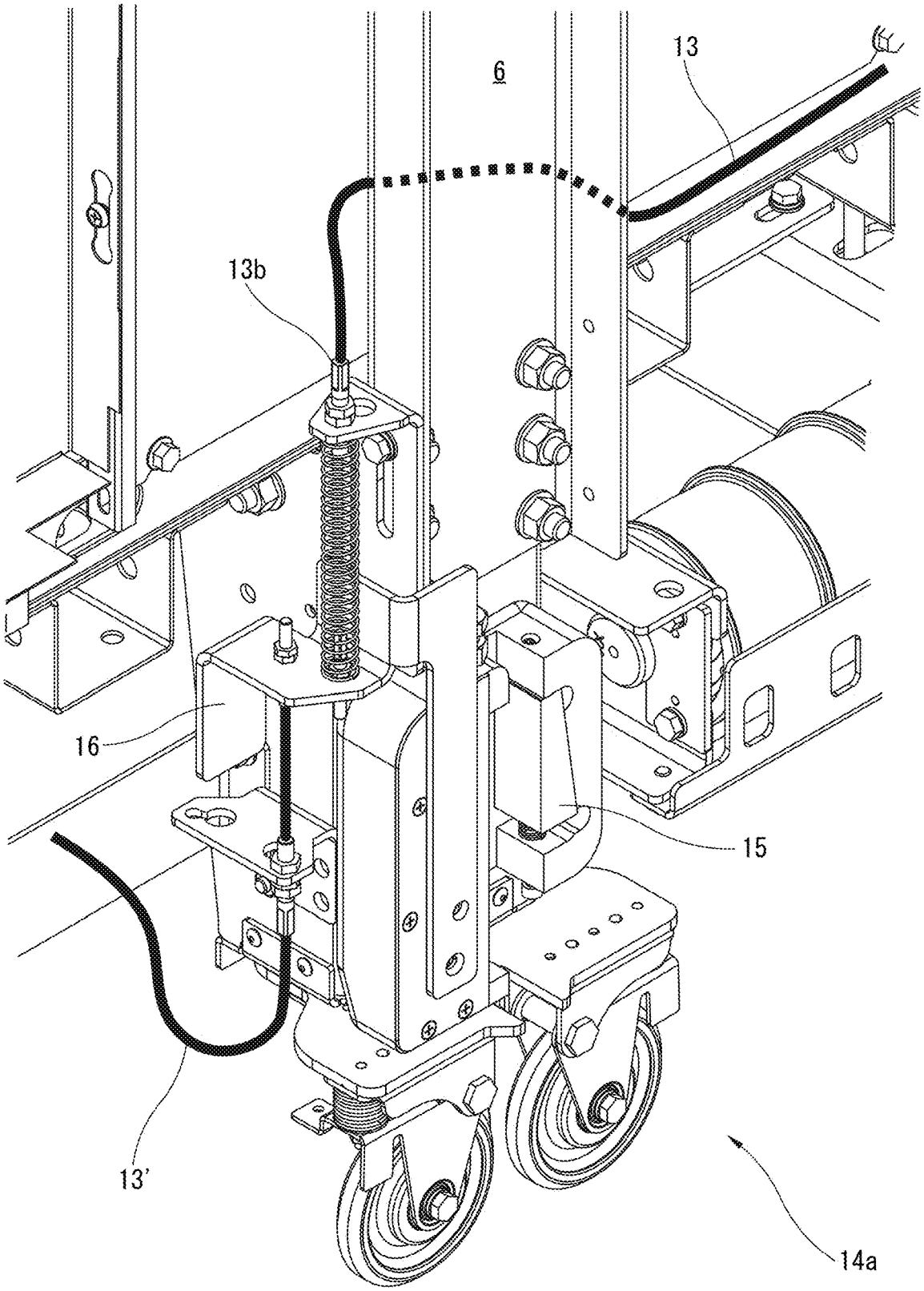
FIG. 4 is a schematic perspective view of one of a pair of safeties including an actuation wire connected to the safety link in accordance with the present invention.
Figure 5:
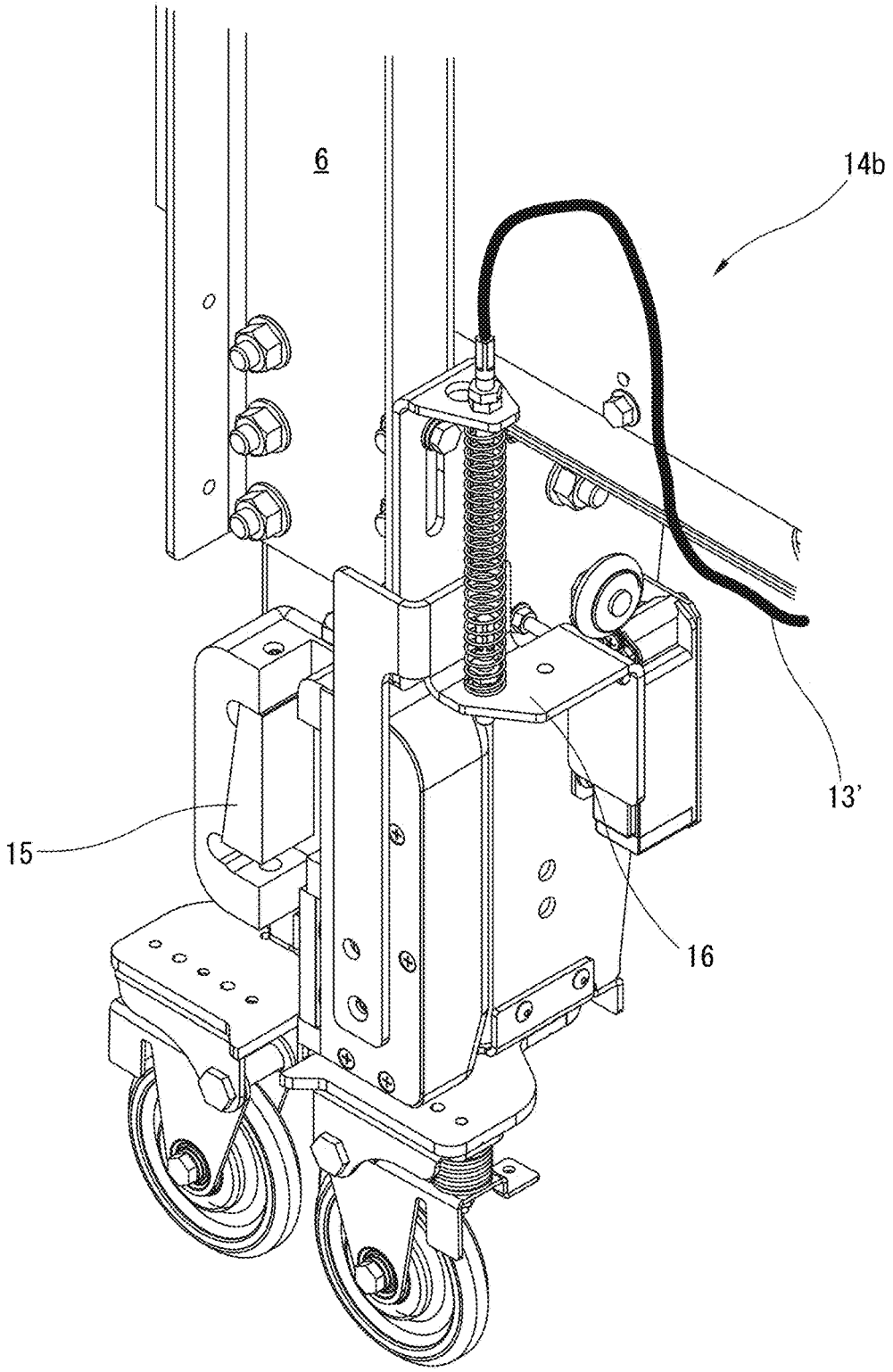
FIG. 5 is a schematic perspective view of the other of a pair of safeties including an actuation wire connected to the safety link in accordance with the present invention.

The hitch bracket 8 also comprises a rotatably mounted pulley 12 configured such that an actuation wire 13 with its one end 13*a* fixed to the base bracket 7 is directed upward to the pulley 12, wrapped 180° around the pulley 12 and then directed downward through the base bracket 7 for connection to a safety device 14 with the other end 13*b* of the actuation wire 13 as shown for example in FIGS. 4 and 5. The two extending portions of the actuation wire 13 extending out from the pulley 12 are arranged parallel with one another. As can be appreciated by a person skilled in the art, the actuation wire 13 includes a flexible sheath surrounding the wire portion.

Referring now to FIGS. 4 and 5, one example of a safety device is shown schematically as 14. Each of the safeties 14*a, b* located on either side of the elevator car 1 includes brake pads, e.g., safety wedges 15 connected to the elevator car frame 6. The safety wedges 15 are positioned on opposing sides of the guide rail 3 (not shown). The safety wedges 15 are normally spaced apart from the guide rail 3 to allow free movement of the elevator car 1. The other end 13*b* of the actuation wire 13 (with one end 13*a* attached to the safety link 2 in FIG. 2) is attached to the tension bracket 16 of the safety 14*a*. The tension bracket 16 of the safety 14*a* in FIG. 4 is further connected to the tension bracket 16 of the other safety 14*b* shown in FIG. 5 via a second actuation wire 13'.

A safety device equipped with the safety link 2 of the present invention is operated as follows. In the event that the elevator car 1 moves downwardly at a speed higher than a predetermined speed, the governor 4 operates to exert a braking force on the governor sheave (not shown), which causes the governor rope 5 in FIG. 2 to pull up with respect to the elevator car 1. When the governor rope 5 shown in FIG. 2 is pulled up, the pulley 12 of the safety link 2 is also pulled up together with the hitch bracket 8 relative to the base bracket 7, and thereby the actuation wire 13 wound around the pulley 12 is pulled upward. This causes the tension bracket 16 (FIGS. 4 and 5) to pull upward to actuate the safety device 14. In other words, the brake pads or safety wedges 15, which are connected to the actuation wire 13, 13', are forced into frictional contact with the guide rails 3 to prevent further movement of the elevator car 1.

As shown in FIGS. 2 and 3, the actuation wire 13 has a 2:1 roping configuration with a pulley 12. Thus, during operation of the safety device 14, the movement of the actuation wire 13 is twice as much as the corresponding movement of the governor rope 5.

Since the moving distance of the actuation wire 13 is converted to twice the upward movement of the governor rope 5, the activation time required by the safety device 14 will be half that of conventional models. It makes it possible to prevent an increase in elevator car downward movement speed due to a time lag between detection of the elevator car descending at extremely high speed and the actuation of the safety device 14. The present invention can provide a safety device that stops the movement of the elevator car at much faster rate than a conventional safety device.

In accordance with the present invention, the safety link 2 with an actuation wire 13 configured with 2:1 roping allows for a higher-speed response to the event of the elevator car to travel at an excessive speed and allows for faster operation of the safety device 14. Furthermore, since the load applied to the tension bracket 16 and the safeties 14*a, b* is halved by the 2:1 roping, the present invention can provide a simple and lightweight safety link mechanism while eliminating the risk of damaging the elevator equipment due to a large amount of load applied to the safety device in the event of a downward overspeed condition.

While the present invention has been particularly shown and described with reference to the exemplary embodiments as illustrated in the drawings, it will be recognized by those skilled in the art that various modifications may be made without departing from the spirit and scope of the invention as disclosed in the accompanying claims.

What is claimed is:

1. A safety link for an elevator traveling in an elevator hoistway, the elevator including a governor assembly and a governor rope extending throughout the hoistway, the safety link comprising:

a hitch bracket slidably mounted to an elevator car frame so as to be movable in the moving directions of the elevator car and biased toward the downward movement direction of the elevator car in normal operating condition, the hitch bracket connected to the governor rope;

a pulley rotatably mounted to the hitch bracket; and an actuation wire wrapped around the pulley, one end of the actuation wire fixed to the elevator car frame so that the one end is directed downwardly relative to the pulley and the other end of the actuation wire directed downwardly and connected to a safety device that stops the movement of the elevator car in the event of a downward overspeed condition, wherein the one end of the actuation wire is fixed to remain stationary relative to the elevator car frame.

2. The safety link of claim 1, further comprising a base bracket mounted to the elevator car frame to slidably hold the hitch bracket.

3. The safety link of claim 1, wherein the movement of the actuation wire is twice as much as the corresponding movement of the governor rope.

4. The safety link of claim 1, wherein the actuation wire is wrapped 180° around the pulley.

5. The safety link of claim 1, wherein the actuation wire has a 2:1 roping configuration with the pulley.

6. The safety link of claim 1, wherein the hitch bracket is guided by a guide slot arranged in the hitch bracket and a guide bolt that slidably connects the hitch bracket through the guide slot to the elevator car frame.

7. The safety link of claim 1, wherein the safety link is arranged near the bottom of the side surface of the elevator car frame.

8. The safety link of claim 1, wherein the governor rope is connected to the hitch bracket by means of bolts.

9. The safety link of claim 1, wherein the safety device comprises a pair of safeties mounted on either side of the elevator car frame for applying a braking force to a pair of guide rails in response to the actuation of the governor rope.

10. The safety link of claim 9, wherein the pair of safeties are linked together through a second actuation wire.

11. A safety link for an elevator traveling in an elevator hoistway, the elevator including a governor assembly and a governor rope extending throughout the hoistway, the safety link comprising:

a hitch bracket slidably mounted to an elevator car frame so as to be movable in the moving directions of the elevator car and biased toward the downward movement direction of the elevator car in normal operating condition, the hitch bracket connected to the governor rope; and a pulley rotatably mounted to the hitch bracket; and an actuation wire wrapped around the pulley and connected to a safety device for actuation in response to the upward movement of the governor rope, wherein the actuation wire has a 2:1 roping configuration with the pulley and the movement of the actuation wire is twice as much as the corresponding movement of the governor rope, wherein one end of the actuation wire fixed to the elevator car frame and the other end of the actuation wire is connected to the safety device, wherein the one end of the actuation wire is fixed to remain stationary relative to the elevator car frame.

12. The safety link of claim 11, further comprising a base bracket mounted to the elevator car frame to slidably hold the hitch bracket.

13. The safety link of claim 11, wherein the hitch bracket is guided by a guide slot arranged in the hitch bracket and a guide bolt that slidably connects the hitch bracket through the guide slot to the elevator car frame.

14. The safety link of claim 11, wherein the safety link is arranged near the bottom of the side surface of the elevator car frame.

15. The safety link of claim 11, wherein the safety device comprises a pair of safeties mounted on either side of the elevator car frame for applying a braking force to a pair of guide rails in response to the actuation of the governor rope.

16. The safety link of claim 15, wherein the pair of safeties are linked together through a second actuation wire.

* * * * *